United States Patent [19]

Keglewitsch et al.

[11] 4,274,700

[45] Jun. 23, 1981

[54] LOW COST ELECTRICAL CONNECTOR

[75] Inventors: Josef Keglewitsch, Addison; Daniel P. Vladic, Berwyn, both of Ill.

[73] Assignee: Bunker Ramo Corporation, Oak Brook, Ill.

[21] Appl. No.: 14,004

[22] Filed: Feb. 21, 1979

Related U.S. Application Data

[63] Continuation of Ser. No. 841,272, Oct. 12, 1977, abandoned.

[51] Int. Cl.[3] ..... H01R 13/52

[52] U.S. Cl. ..... 339/192 R; 339/211; 339/221 M

[58] Field of Search ..... 339/59 R, 59 M, 94 R, 339/94 A, 176 M, 192 R, 195 M, 196 M, 211, 220 R, 220 T, 221 R, 221 M, 258 R, 258 P; 174/153

[56] References Cited

U.S. PATENT DOCUMENTS

| | | | |
|---|---|---|---|
| 2,764,751 | 9/1956 | Gnadke | 339/128 |
| 2,828,474 | 3/1958 | Fox | 339/47 R |
| 2,964,724 | 12/1960 | Fox | 339/49 R |
| 2,995,617 | 8/1961 | Maximoff et al. | 339/221 M |
| 3,101,983 | 8/1963 | Van Horssen | 339/59 R |
| 3,336,570 | 8/1967 | Tuchel | 339/220 R |
| 3,363,223 | 1/1968 | Hardesty et al. | 339/221 R |
| 3,398,391 | 8/1968 | Brishka | 339/94 A |
| 3,414,867 | 12/1968 | Travis | 339/258 P |
| 3,631,381 | 12/1971 | Pittman | 339/176 MP |

FOREIGN PATENT DOCUMENTS

| | | | |
|---|---|---|---|
| 44-21071 | 9/1969 | Japan | 339/211 |
| 1349432 | 4/1974 | United Kingdom . | |
| 1456265 | 11/1976 | United Kingdom . | |

OTHER PUBLICATIONS

Continental Connectors Advertisement, DeJur-Amsco Corp., Long Island City, N.Y. 6-1955.

*Primary Examiner*—Neil Abrams
*Attorney, Agent, or Firm*—F. M. Arbuckle; J. R. Hoffman

[57] ABSTRACT

An electrical connector is disclosed particularlity for use between a printed circuit board and another electrical component. A body member of dielectric material is provided having first and second exterior surfaces and a plurality of spaced-apart, contact-receiving apertures extending therethrough between the surfaces. Each aperture has a narrow cavity region, a shoulder cavity region, and a wide cavity region extending seriatim from the first to the second exterior surfaces. A plurality of electrical contacts are disposed in respective ones of the apertures, each contact including a terminal portion press-fit within the narrow cavity region, a shoulder cavity region, and an active contact portion extending into the wide cavity region for connection to another electrically conductive element. The press-fit of the terminal portion and the shoulder portion and the raised ridges between the contact and aperture together define a substantially irregular and constricted path through the aperture from the wide cavity region to the first exterior surface to provide an essentially liquid impervious passage. The active contact portion comprises a pair of spaced parallel prongs disposed within a long dimension of the wide cavity region, and oppositely disposed semi-cylindrical regions are provided intermediate the ends of the long dimension to accommodate a generally cylindrical male contact member inserted into the aperture.

29 Claims, 8 Drawing Figures

LOW COST ELECTRICAL CONNECTOR

This is a continuation of application Ser. No. 841,272, filed Oct. 12, 1977, now abandoned.

BACKGROUND OF THE INVENTION

The present invention is directed generally to electrical connectors and, more particularly, to an electrical connector for providing interconnection between one or more printed circuit board panels and an external power source or other electrical components.

In recent years, the use of electronic components and particularly modular electronic components have met with increased use in an ever-expanding diversity of applications. One area of use which is developing rapidly is in the automotive industry where electronic ignition, braking and carberation systems, as well as others, are being developed. These electronic systems require connectors and other circuitry components which provide reliable and long lasting performance under severe environmental conditions. Thus, printed circuit boards and their associated connectors must be capable of withstanding wide variations in temperature, extreme dirt and moisture conditions and severe vibration as well.

In order to overcome at least some of these environmental problems, circuit board and connector assemblies have been coated with insulating liquids, such as silicone, which cure to form a plastic conformal coating. These liquids, however, have created another problem in that they are able to seep or wick into small crevices and apertures, and in some instances, have found their way into the active contact areas of the associated connectors, thereby impairing the quality of the electrical connection within mated connectors.

In addition, the space and circuitry requirements in many automotive applications dictate that a small connector carry a number of individual circuits. Thus, connectors having high density contact arrangements are often necessary.

Finally, a need exists for an extremely low cost connector which meets these performance specifications and is capable of intermatability with existing connectors presently used in these applications. Of particular importance, is the need to eliminate the costly screw machine pin and socket contacts of existing prior art connector, while maintaining intermatability with these same connectors. It should be appreciated that the molding of two separate halves, the assembling of those parts with a metal skirt, and the forming of the contacts on a screw machine, is both extremely time consuming and labor expensive and therefore significantly increases the cost of production of such prior connectors. Moreover, the generally cylindrical apertures formed in such connectors, together with their immediate juxtaposition on the printed circuit board may permit the conformal coating in which the assembled circuit board is dipped, to creep or wick into the active contact portion of the electrical contacts and consequently prevent proper electrical contact between the connector contact and the associated element.

SUMMARY OF THE INVENTION

Accordingly, the present invention is directed to an improved electrical connector particularly suited for interconnection with a printed circuit board and another electronic component and which obviates and overcomes the above-noted problems associated with prior art connectors. The connector comprises a one piece insert with specially configured contact-receiving apertures in which similarly configured contacts are mounted. The connector inserts one piece construction eliminates assembly operations customarily associated with the prior art connectors of this same general type which typically include two inserts and a metal skirt or housing.

The contacts are economically and expeditiously fabricated from sheet metal stock by a simultaneous punch-press and cold-forming operation and are capable of mating with the pin and socket contacts utilized in conventional connectors.

The special configuration of the contacts and their associated apertures substantially eliminates the wicking and seepage of the conformal coatings which are frequently applied to such connectors.

Another feature of the present invention is the provision of an electrical connector wherein the male pin contact is oriented in a 90° direction relative to the conventional configuration, thereby permitting an arrangement having greater separation between adjacent contacts and the use of a greater number of such contacts in the same usable space.

Still another feature of the present invention is the provision of an electrical connector of the type set forth which carries integral fastening means so that the connector is easily snap-mounted in position on an associated circuit board.

The connector constructed in accordance with the present invention comprises a one-piece plastic body member having a main body portion, first and second exterior surfaces, and at least one contact-receiving aperture extending therethrough between the surfaces. The exterior surfaces are adapted to be received in cooperative juxtaposition with associated members having electrically conductive elements. Each aperture has a narrow cavity region and a shoulder cavity region communicating with the narrow cavity region and cooperating therewith to define an offset shoulder surface. At least one electrical contact formed by a punch-press operation is disposed in the aperture, each contact including a terminal portion, a shoulder portion and an active contact portion. Each terminal portion is shaped complementary to and press-fitted within the narrow cavity region and extends outwardly beyond the first exterior surface for connection to another electrically conductive element. Each contact shoulder portion is shaped complementary to and press-fitted the shoulder cavity region of the aperture, in mating engagement with the shoulder surface. The active contact portion extends beyond the shoulder cavity region for connection to another electrically conductive element. Each contact shoulder portion also includes a plurality of raised ridges formed on opposite sides thereof and extending in a direction normal to the axis of the aperture, whereby the press-fit of the terminal portion and the shoulder portion and the raised ridges thereon together define an irregular, constricted and circuitous path through the aperture to provide an essentially liquid impervious juncture which prevents seepage of an associated liquid insulative material to the active contact portion of the electrical contact.

BRIEF DESCRIPTION OF THE DRAWINGS

The novel features which are considered characteristic of the present invention are set forth with particularity in the appended claims. The invention itself, together with further objects and advantages thereof, may best be understood by reference to the following description, taken in connection with the accompanying drawings, in which:

DESCRIPTION OF THE PREFERRED EMBODIMENT

Figure 1:
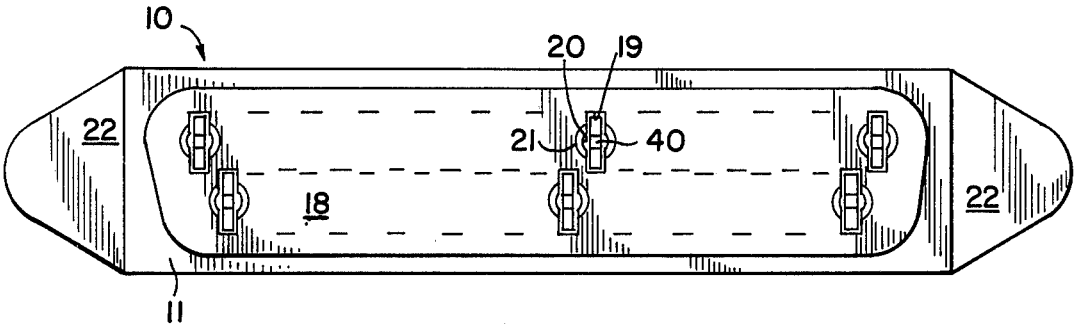
FIG. 1 is a plan view of an electrical connector constructed in accordance with and embodying the features of the present invention and illustrated in the form of a female receptacle.
Figure 2:
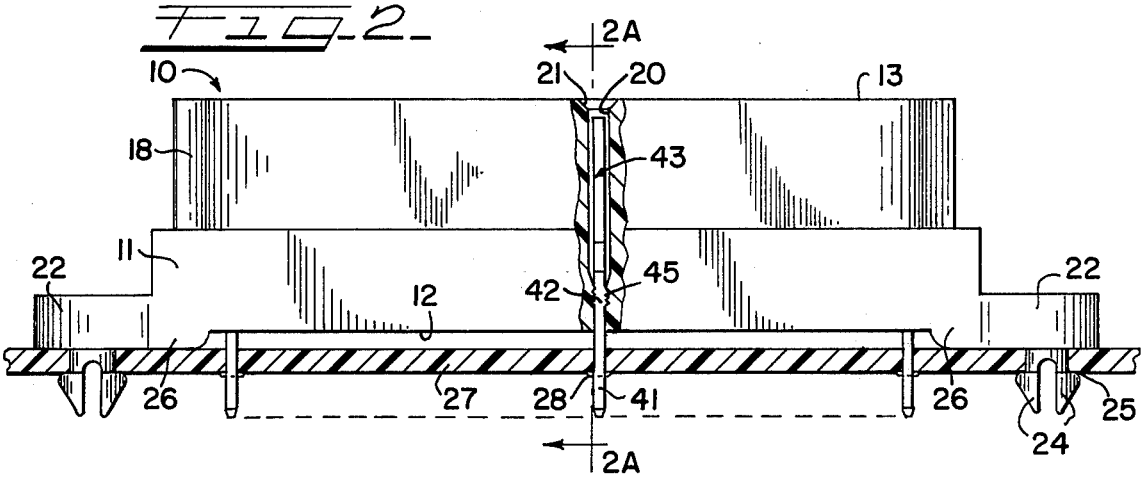
FIG. 2 is a side elevational view of the connector of FIG. 1, with a portion of the body member broken away to show the internal construction of the electrical contact therein and also illustrating the connector secured to a printed circuit board.
Figure 3:
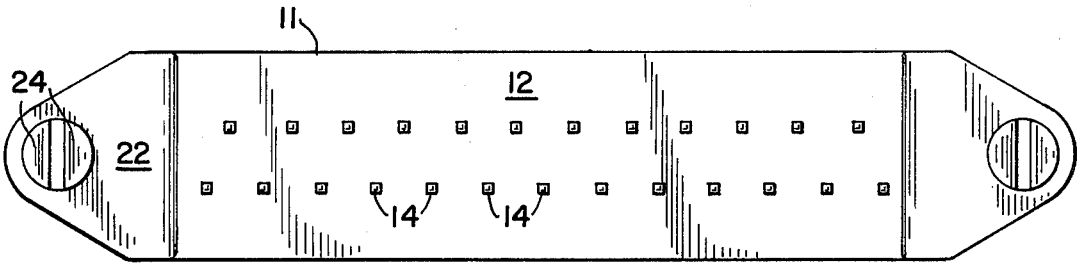
FIG. 3 is a bottom view of the connector of FIG. 1.
Figure 4:
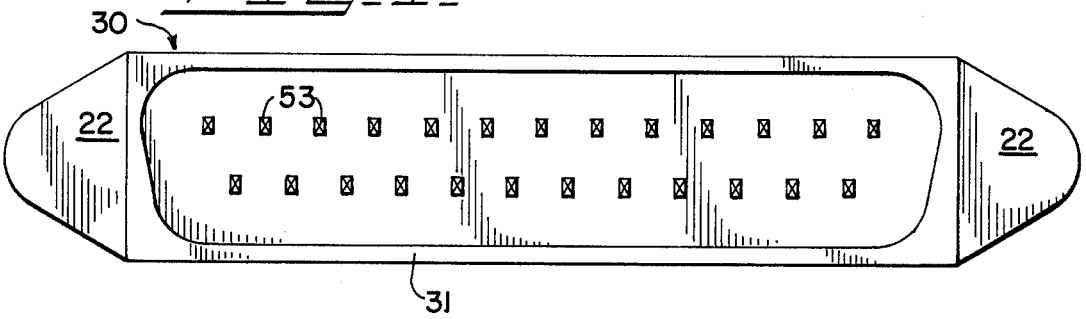
FIG. 4 is a plan view of a male electrical connector constructed in accordance with and embodying the features of the present invention.
Figure 5:
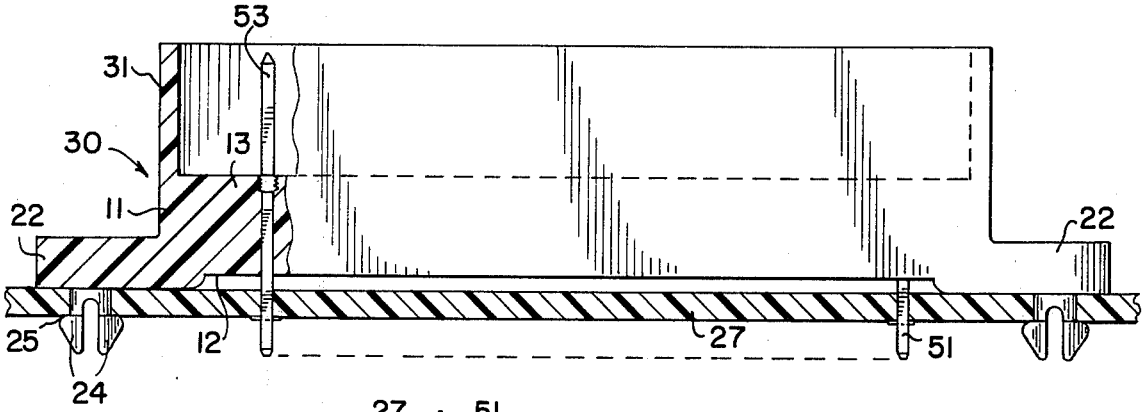
FIG. 5 is a side elevational view of the connector of FIG. 4, with portions thereof broken away and illustrating a male electrical contact mounted in the connector.

Illustrated in the drawings is a pair of electrical connectors made in accordance with the present invention, and in the form of a receptacle or female connector, designated generally by the numeral 10, illustrated in FIGS. 1–3, and a complementary male or plug connector, designated generally by the numeral 30, and illustrated in FIGS. 4 and 5. The male and female connectors of FIGS. 1 and 4 are shown in section and in assembled relation in FIG. 7.

The female connector 10 includes a main body portion 11 formed of a thermoplastic material and is generally rectangular in shape and includes a first exterior surface 12 and a second oppositely disposed exterior surface 13. The connector 10 has a plurality of spaced-apart contact-receiving apertures 14 extending therethrough between the exterior surfaces 12 and 13.

Each aperture 14 has a narrow cavity region 15 opening at the first exterior surface 12 and extending inwardly part way through the main body portion 11 to an offset shoulder 16 (FIG. 2A) disposed substantially perpendicular to the longitudinal axis of the narrow cavity region 15. At the offset shoulder 16 the aperture is enlarged to provide a shoulder cavity region 17 which extends toward said second exterior surface 13.

The main body portion 11 of the female connector 10 includes an upper body portion 18, the second exterior surface 13 being disposed on this upper body portion 18. The section of the aperture 14 passing through the upper body portion 18 comprises a wide cavity region 19, greater in cross-sectional area than the shoulder cavity region 17, for reasons hereinafter explained.

Figure 7:
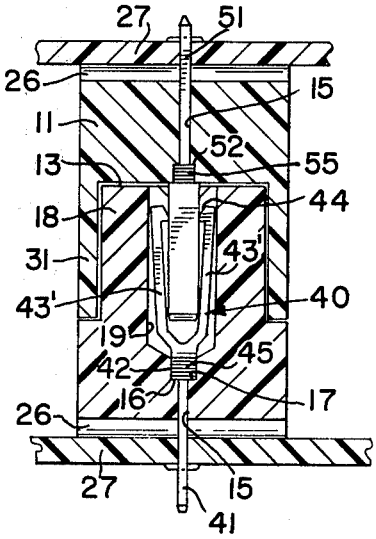
FIG. 7 is a cross-sectional view of the connectors of FIGS. 1 and 4 as assembled together, showing the mating relationship of the male and female electrical contacts and other mating parts.
Figure 6:
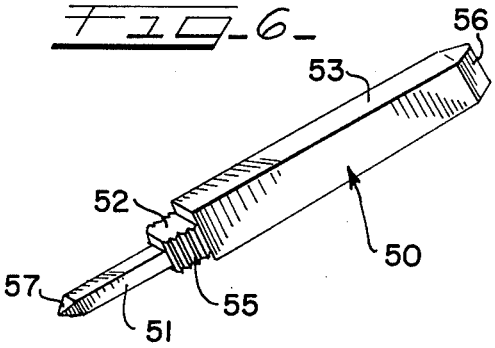
FIG. 6 is an enlarged perspective view of a male electrical contact made in accordance with and embodying the features of the present invention.

Disposed in each aperture 14 is a female electrical contact 40 (FIGS. 1 and 7). Each contact 40 includes an elongated tail or terminal portion 41 (see FIG. 1), an enlarged shoulder portion 42, and an active contact portion 43. The terminal portion is substantially complementary in cross section to the narrow cavity region 15, while the shoulder portion 42 corresponds substantially to the configuration of the shoulder cavity region 17 of aperture 14. Each contact 40 is further provided with a plurality of spaced raised ridges 45 integrally formed on the opposite faces thereof from the shoulders; the ridges extending from the face of the contact in a direction generally normal to the longitudinal axis of the contact 40.

The active contact portion 43 of the female connector is comprised of a pair of spaced, parallel prongs 43' connected at the shoulder portion 42. The contact 40 is thus shaped substantially like a tuning fork. Each prong 43' preferably is provided with a downwardly and inwardly directed gripping nib 44 (FIG. 7). The prongs 43' and nibs 44 serve to releasably engage the active contact portion 53 of an associated male contact member 50. The inclined entry formed by the inlet portion of the nibs serves to guide the male contact into the proper mating position.

Each contact 40 is press fitted into its respective aperture 14. The press-fit of the terminal portion 41 and shoulder portion 42 in the respective cavity regions 15 and 17, and the forced engagement of the raised ridges 45 with the walls of the aperture opposite the shoulder offset portions 16, assure that the contact 40 will not be accidentally pulled from the aperture as the male connector is removed therefrom.

Moreover, and of particular importance, the constricted and irregular or circuitous path defined by the press-fit of terminal portion 14, the offset shoulder 16, and the raised ridges 45, provide an essentially liquid impervious juncture which prevents seepage of the conformal coating therethrough to the active contact portion when an assembled circuit board is dipped into the liquid insulative coating.

As previously noted, an important feature of the invention is the forming of the contacts by a low-cost stamping operation. This method of fabrication results in a relatively flat contact which is substantially rectangular in cross section along its longitudinal axis. The connectors of the present invention using these stamped contacts are preferably cooperable with prior art connectors using rounded plugs or sockets of the type formed on a screw machine. In this regard, the upper body portion 18 surrounding the active contact protion 43, and defining the wide cavity region 19, is specially configured to also allow insertion of a round male member.

Figure 2A:
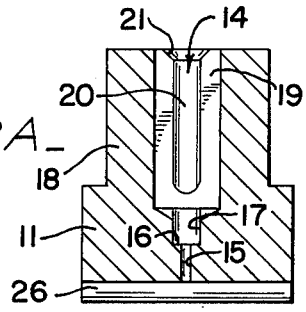
FIG. 2A is a cross-sectional view of the connector taken along line 2A—2A in FIG. 2, and without a contact mounted in the connector.

As best seen in FIGS. 1, 2 and 2A, the wide cavity region 19, in the direction lying in the plane of the prongs 43', is rectangularly shaped and is spaced from the prongs 43' so as to allow limited outward flexing of the prongs 43' when an associated male mating contact member is inserted therebetween. In addition, as shown in FIGS. 1 and 2, at least a portion of the area defining the wide cavity region also is partly generally circular in cross section, as shown at 20, in the length of the aperture from the shoulder cavity region 17 toward the second exterior surface 13. The two semi cylindrical regions 20 are formed in the walls of the aperture 14 at 90° positions relative to the major cross-sectional dimension of the rectangle defining the wide cavity region 19. The semi cylindrical regions 20 permit the connector 10 to receive a male connector having either a rectangular or round pin male contact. To help guide floating pin contacts of prior art connectors into the apertures 14, each aperture is provided with a partly conical entryway 21 leading into the semi cylindrical portions 20 thereof. As best seen in FIG. 2, the prongs 43' terminate below the second, or upper exterior surface 13, whereby the upper body portion 18 provides an insulating barrier between adjacent contacts.

To permit the maximum number of contacts 40 to be utilized in the connector 10, the apertures 14 (and contacts 40) are arranged in two parallel rows with the apertures in one row being spaced approximately midway between the apertures of the second row. The rectangularly disposed apertures 14 are arranged so that the major dimension of each aperture is perpendicular to the plane defined by the row of parallel apertures, to thereby permit closer spacing of the contacts within the parallel row. Moreover, by offsetting the apertures of the adjacent row, it is possible to more closely space the adjacent rows. The advantage of this array will best be understood when considered with the description hereinafter of the male connecter member.

The main body portion 11 of the connector 10 is provided with a pair of fastening flanges 22 integrally formed therewith and disposed at and extending outwardly from opposite ends thereof. While the flanges 22 may be provided with apertures to accommodate conventional fastening means, such as screws or rivets, the connector 10 of the present invention is provided with integrally formed fastening means in the form of pairs of spaced fingers 24 extending outwardly from each fastening flange 22 in opposed parallel relation. Each finger 24 is preferably wedge shaped and is provided with an outstanding shoulder portion 25 at the largest segment of the wedge, the shoulder portion 25 being spaced from the adjacent fastening flange 22 a distance approximately equal to the thickness of the associated circuit board 27. The fingers are flexible, resilient and are movable toward each other such that, when the connector 10 is placed on the adjacent circuit board 27 and pressure is applied to each flange 22, the wedge shape of the fingers 24 facilitates their passage through the board opening, after which the fingers 24 snap back to their original position with the circuit board 27 tightly gripped between the shoulders 25 and the adjacent fastening flange 22.

To help preclude creeping or wicking of the conformal coating by capillary action into the apertures 14, the main body portion 11 of connector 10 also is provided with elevating flanges 26 at opposite ends thereof, the flanges extending outwardly from the first exterior surface and serving to space that surface from the printed circuit board 27. Of course, other spacing means well known to those skilled in the art may also be employed.

As best seen in FIG. 2, when the connector 10 is mounted on the printed circuit board 27, the terminal portions 41 of the contacts 40 extend from the connector 10 through suitably provided apertures in the circuit board 27 whereupon the terminal contact portion is wave soldered as at 28 to the circuit connection on the board. The terminal portion 41 is elongated and is intended to extend for a short distance beyond the soldered portion 28 thereof whereby a suitable test clip may be connected to the terminal portion 41 for test purposes.

With reference now to the male connector 30, like reference numerals have been applied to its components like those of the female connector. The male connector 30 includes the main body portion 11, first and second exterior surfaces 12 and 13, and a plurality of generally rectangular apertures 14. For the male connector, the semi cylindrical portions 20 and conical entryways 21 of the female connector are unnecessary. The male connector 30 is provided with the fastening flanges 22 and fastening means 23 including the wedge-shaped fingers 24 having the outwardly disposed shoulders 25 thereon. In addition, the body portion 11 is provided with the elevating flanges 26 which serve to space the first exterior surface 12 from the circuit board 27.

Each aperture 14 is provided with the narrow cavity region 15, and the offset shoulder 16, defining the shoulder cavity region 17. Unlike the female connector 10, there is no solid upper body portion 18 containing the wide cavity regions 19 which act as integral parts of the aperture 14. Instead, the main body portion 11 of the male connector 30 is provided with a raised peripheral wall portion 31 extending outwardly from the second exterior surface 13 and beyond the end of the active contact portion 53 of the male contact members. The peripheral wall portion 31 circumscribes the area of the body portion 11 occupied by the male contact members to thereby protect such members from damage and provide an insulating and retaining wall when the male connector is assembled and in mating engagement with a complementary associated female connector, as best seen in FIG. 7. To this extent, the peripheral wall portion 31 on the male connector 30, and the upper body portion 18 on the female connector 10, are generally trapezoidal in configuration and complementary in shape, thereby to provide polarizing engagement with one another when the connectors 10 and 30 are mated.

The male electrical contact 50 also is punch pressed from a sheet metal stock and is generally rectangular in cross section. The contact 50 includes an elongated tail or terminal portion 51, an offset shoulder portion 52 and an elongated and generally rectangular further enlarged offset active contact portion 53. The opposite ends of the contact 50 are preferably flattened and deformed as at 56 and 57 during the punch press operation. The flattened end 56 of the contact portion facilitates its insertion into a female contact member, while the flattened end 57 facilitates insertion into the connector aperture. In addition, the contact 50 is provided with a series of parallel raised ridges 55 formed on the shoulder portion 52 thereof and extending in a direction normal to the longitudinal axis of the contact 50. The raised ridges are cold formed in the contact 50 during the punch press forming operation.

As was the case for the female contact 40, the terminal portion 51 and shoulder portion 52 correspond substantially to the configuration of the narrow contact region 15 and shoulder cavity region 17 in the main body portion 11 of the connector 30, whereby the offset shoulders, the press-fit, and the raised ridges together define a constricted and circuitous pathway through the aperture 14 which inhibits the wicking and creeping action of the conformal coating through the aperture to the active contact portion of the contact.

After the male contact members 50 are punch pressed from a sheet metal stock, it is preferable to subject them to a tumbling operation prior to their insertion into the connector 30. This will effectively round the longitudinal edges of the active contact portion 53 thereof, whereby the male contact 50 can function as a pin in a rounded prior art socket, as well as functioning as the male contact for the female contact 40 illustrated herein. Also, the major cross-sectional dimension of the new pin is approximately equal to the diameter of the prior art round pin previously used, whereby insertion of either the new form of male contact, or the round pin contact into the tuning fork contact 40 of the present invention, will result in substantially the same force being applied to the prongs 43' of the contact 40. Rounding of the edges of the active contact portion 53 of contact 50 will prevent scoring in the event such type of contact is used with the prior art female connector having round sockets.

As previously noted, one advantageous feature of the invention is the orientation of the male connector in a direction 90° to its usual arrangement when inserted between the arms of a tuning fork contact. Previously, blade or space contacts have been typically inserted in a tuning fork contact with the longer cross-sectional dimension of the blade orientated 90° to the plane of the tuning fork prongs. In contrast thereto, the male contacts 50 of the present invention are oriented such that the major dimension thereof extends in the plane of the tuning fork prongs 43'. This orientation results in several advantages. First, there will be better electrical contact between the male and female members as more force will be applied to the female contact prongs, thus assuring positive contact. Second, the 90° rotation allows the male member to be formed of less metal, resulting in a savings in material. Third, by effecting the 90° rotation, adjacent contacts (both male and female) can be spaced more closely together than would be the case if the major dimension lay in the plane defined by the row of parallel contacts, this closer spacing thus resulting in a connector having a higher density of contacts therein.

Both the male and female connectors 10 and 11 preferably are molded of a thermoplastic material in a one-shot injection molding operation. The thermoplastic material is selected not only because of its insulating properties but it has desirable cold-flow properties which, when the respective contacts are inserted in the respective apertures, allow the apertures to conform to the contacts as they are press fitted therein. One desirable thermoplastic material for use herein is a glass-filled polyester. The male contact member preferably is stamped from cartridge brass sheet metal stock which may be plated with a thin gold film thereon. The female contact 40 may be stamped from a copper alloy.

It should be apparent from the foregoing that a novel form of electrical connector has been provided which is inexpensive to produce, capable of mating with its own male and/or female counterpart, having the appropriately designed body portion and contacts, and which is also interchangeable with the prior art connectors having round pin and cylindrical socket contacts.

Finally, and most importantly, since the prongs 43' will be displaced a greater distance, the gap between the prongs 43' in their unstressed, free-standing position can be greater than would otherwise be possible. This larger gap, particularly at nibs 44, allows the tuning fork contact 40 to be economically fabricated by a punch-press operation. If the dimension of this gap were to be reduced, punch press fabrication of the tuning fork contact 40 would be more difficult and, perhaps, not commercially feasible.

While there has been described what is at present considered to be the preferred embodiment of the invention, it will be understood that various modifications may be made therein, and it is intended that the appended claims cover all such modifications as fall within the true spirit and scope of the invention.

What is claimed is:

1. An electrical connector comprising:

a dielectric body member including a main body portion having first and second exterior surfaces adapted to be positioned in cooperative juxtaposition with associated members having electrically conductive elements, said main body portion having a plurality of spaced-apart, contact-receiving apertures extending therethrough between said surfaces;

each aperture having a narrow cavity region extending inwardly from said first exterior surface, a shoulder cavity region wider than said narrow cavity region and extending inwardly from said narrow cavity region toward said second exterior surface, and a wide cavity region wider than said shoulder cavity region and extending from said shoulder cavity region to said second exterior surface;

said shoulder cavity region communicating with said narrow cavity region and cooperating therewith to define an offset shoulder surface disposed substantially normal to the longitudinal axis of said narrow cavity region; and a plurality of electrical contacts disposed in respective ones of said apertures, each contact including a terminal portion, a shoulder portion and an active contact portion, each said terminal portion being shaped complementary to and disposed snugly in said narrow cavity region of said aperture and extending outwardly beyond said first exterior surface for connection to another electrically conductive element;

each said shoulder portion being shaped complementary to and disposed in a water-tight fit in said shoulder cavity region of said aperture in mating engagement with said shoulder surface, each said shoulder portion having at least one ridge on opposite faces thereof isolated from said narrow cavity region and said wide cavity region and extending in a direction substantially normal to the longitudinal axis of said aperture;

said active contact portion extending into said wide cavity region for connection to another electrical component;

whereby said snug fit of said terminal portion, said water-tight fit of said shoulder portion, said offset shoulder surface and said ridge together define a substantially irregular and constricted path through said aperture to thereby provide an essentially liquid impervious juncture which prevents seepage to said active contact portion.

2. The electrical connector set forth in claim 1, wherein each of said electrical contacts comprises a relatively flat unitary metal member and the terminal and shoulder portions of each said aperture is generally rectangular in cross section in a plane perpendicular to the aperture axis.

3. The electrical connector set forth in claim 2, wherein said contacts are cold-formed from sheet metal stock.

4. The electrical connector set forth in claim 2, wherein the active contact portion of each of said electrical contact comprises a pair of spaced parallel prongs connected at said shoulder portion, said contact being substantially configurated in the shape of a tuning fork with said prongs serving to releasably grasp an associated male mating member inserted therebetween and to provide electrical contact therewith, whereby said connector serves as a female receptacle adapted to receive a plurality of male mating members therein.

5. The electrical connector set forth in claim 4, wherein said body member includes an upper body portion through which said apertures extend, said second exterior surface being disposed on said upper body portion, the portion of each said apertures contained by said upper body portion defining said wide cavity region therein so that said upper body portion is spaced from the prongs of said contact so as to permit limited outward flexing of said prongs when an associated male mating contact member is inserted therebetween, said upper body portion thereby providing an insulating barrier between adjacent ones of said contacts.

6. The electrical connector set forth in claim 5, wherein said active contact portion defined by said spaced prongs is recessed below the second exterior surface of said upper body portion.

7. The electrical connector set forth in claim 5, wherein said wide cavity region in said upper body portion surrounding said parallel prongs includes oppositely disposed semi cylindrical regions extending from said shoulder cavity region throughout said wide cavity region, thereby to accommodate a generally cylindrical male mating member inserted between said prongs.

8. The electrical connector set forth in claim 7, wherein each said aperture is provided with a generally conical entryway at said second exterior surface, to thereby guide a mating male member into position in said aperture.

9. The electrical connector set forth in claim 5, wherein said upper body portion in the area surrounding said active contact portion of said electrical contacts is generally trapezoidal in cross section so as to provide polarizing engagement with an associated complementary electrical component.

10. The electrical connector set forth in claim 1, wherein at least a portion of each of said aperture is generally rectangular in cross section in a plane perpendicular to the longitudinal axis of each aperture, and said apertures are arranged in at least two parallel rows with said apertures in one said row being spaced approximately midway between the apertures of the second said row.

11. The electrical connector set forth in claim 10, wherein each said rectangular aperture has a major dimension and a minor dimension, the major dimension being perpendicular to the plane defined by the row of parallel apertures, thereby to permit closer spacing of the electrical contacts disposed in said apertures along each said parallel row.

12. The electrical connector set forth in claim 1, wherein said body member is formed of a thermoplastic material.

13. The electrical connector set forth in claim 1, wherein said body member is formed of a glass-filled polyester.

14. The electrical connector set forth in claim 1, wherein said body member further includes a pair of fastening flanges integrally formed therewith and extending outwardly from opposite ends thereof, and means for releasably securing said connector to an associated circuit board.

15. The electrical connector set forth in claim 1, wherein said main body portion further includes a pair of flanges disposed at opposite ends thereof and extending outwardly from said first exterior surface so that the area of said first exterior surface containing said apertures is spaced from an associated underlying circuit board, thereby reducing engagement of said apertures with insulative material on the printed circuit board.

16. An electrical connector comprising:

a body member formed of a dielectric material and including a main body portion having first and second exterior surfaces adapted to be positioned in cooperative juxtaposition with associated members having electrically conductive elements, said main body portion having a plurality of spaced-apart, contact-receiving apertures extending therethrough between said surfaces;

each aperture having a narrow cavity region extending inwardly from said first exterior surface, a shoulder cavity region wider than said narrow cavity region and extending inwardly from said narrow cavity region toward said second exterior surface, and a wide cavity region wider than said shoulder cavity region and extending from said shoulder cavity region to said second exterior surface, said shoulder cavity region communicating with said narrow cavity region and cooperating therewith to define an offset shoulder surface disposed substantially normal to the longitudinal axis of said narrow cavity region; and a plurality of electrical contacts disposed in respective ones of said apertures, each contact including a terminal portion, a shoulder portion and an active contact portion, each said terminal portion being shaped complementary to and disposed in press-fit relationship within said narrow cavity region of said aperture and extending outwardly beyond said first exterior surface for connection to another electrically conductive element;

each said shoulder portion being shaped complementary to and disposed in press-fit relationship within said shoulder cavity region of said aperture, each said shoulder portion having at least one raised ridge on opposite faces thereof isolated from said narrow cavity region and said wide cavity region and disposed substantially normal to the longitudinal axis of said aperture;

said active contact portion extending into said wide cavity region for connection to another electrically conductive element;

said press-fit of said terminal portion, said shoulder portion, said offset shoulder surface and said raised ridge together defining a substantially irregular and constricted path through said aperture to provide an essentially liquid impervious juncture which prevents seepage to said active contact portion, said active contact portion comprising a pair of spaced parallel prongs connected at said shoulder portion and serving to releasably engage a male contact member inserted therebetween, said wide cavity region being spaced from said prongs to permit limited outward flexing of said prongs when said male contact member is inserted therebetween.

17. The electrical connector set forth in claim 16, wherein said wide cavity region in said upper body portion surrounding said parallel prongs includes generally semi cylindrical opposed regions extending from said shoulder cavity region throughout said wide cavity region, thereby to accommodate a generally cylindrical male mating member inserted between said prongs.

18. The electrical connector set forth in claim 17, wherein each said aperture is provided with a generally conical entryway at said second exterior surface, thereby to guide a mating male member into position in said aperture.

19. An electrical connector comprising:

a body member formed of a dielectric material and including a main body portion having first and second exterior surfaces adapted to be positioned in cooperative juxtaposition with associated members having electrically conductive elements, said main body portion having a plurality of spaced-apart, contact-receiving apertures extending therethrough between said surfaces;

each aperture having a narrow cavity region extending inwardly from said first exterior surface, a shoulder cavity region wider than said narrow cavity region and extending inwardly from said narrow cavity region toward said second exterior surface, and a wide cavity region wider than said shoulder cavity region and extending from said shoulder cavity region to said second exterior surface, said shoulder cavity region communicating with said narrow cavity region and cooperating therewith to define an offset shoulder surface disposed substantially normal to the longitudinal axis of said narrow cavity region, and each said aperture being generally rectangular in cross section; and a plurality of electrical contacts disposed in respective ones of said apertures, each contact being generally rectangular in cross section and including a terminal portion, a shoulder portion and an active contact portion, each said terminal portion being shaped complementary to and disposed in press-fit relationship within said narrow cavity region of said aperture and extending outwardly beyond said first exterior surface for connection to another electrically conductive element, each said shoulder portion being shaped complementary to and disposed in press-fit relationship within said shoulder cavity region of said aperture, each said shoulder portion having at least one raised ridge on opposite faces thereof isolated from said narrow cavity region and said wide cavity region and extending in a direction substantially normal to the longitudinal axis of said aperture; said active contact portion extending from said shoulder cavity region into said wide cavity region for connection to another electrical conductive element;

whereby said press-fit of said terminal, said shoulder portion, said offset shoulder surface and said raised ridge together define a substantially irregular and constricted path through said aperture to thereby provide an essentially liquid impervious juncture which prevents seepage to said active contact portion.

20. The electrical connector set forth in claim 19, wherein said contacts are arranged in at least two parallel rows with said contacts in one said row being spaced approximately midway between the contacts of the second said row.

21. The electrical connector set forth in claim 20, wherein each said rectangular contact has a major dimension and a minor dimension, the major dimension being perpendicular to the plane defined by the row of parallel contacts, to thereby permit closer spacing of the electrical contacts disposed along each said parallel row.

22. An electrical connector comprising:

a body member including a main body portion having first and second exterior surfaces adapted to be positioned in cooperative juxtaposition with associated members having electrically conductive elements, said main body portion having a plurality of spaced-apart, contact-receiving apertures extending therethrough substantially between said surfaces and being arranged in at least one row thereof;

each aperture having a narrow cavity region extending inwardly from said first exterior surface and a wider cavity region extending from said narrow cavity region toward said second exterior surface, said wider cavity region being elongated in cross section so as to have a long dimension extending generally transversely of said row and a short dimension extending generally parallel to said row and oppositely disposed semi-cylindrical regions intermediate the ends of said long dimension extending generally from said narrow cavity region toward said second exterior surface to accommodate a generally cylindrical male contact member inserted into said aperture; and a plurality of electrical contacts disposed in respective ones of said apertures, each contact including a terminal portion disposed in said narrow cavity region of said aperture and an active contact portion disposed in said wide cavity region of said aperture, said active contact portion comprising a pair of spaced parallel prongs disposed in a common plane generally transversely of said row and within the long dimension of said wide cavity region of said aperture for receiving either said cylindrical contact member or a rectangular contact member sized for termination between said prongs, said semi-cylindrical regions of said aperture being disposed in alignment with the spacing between said prongs so as to position and guide said cylindrical male contact member for acceptance between said prongs.

23. The electrical connector of claim 22 wherein each of said apertures has a shoulder cavity region extending between said narrow cavity region and said wide cavity region and each of said electrical contacts includes a shoulder portion between said terminal portion and said active contact portion disposed snugly in said shoulder cavity region of said aperture.

24. The electrical connector of claim 22 wherein each said apertures are provided with a generally conical entryway at said second exterior surface, to thereby guide a mating male member into position in said aperture.

25. The electrical connector of claim 22 wherein each of said electrical contacts comprises a relatively flat unitary metal member and said terminal portion is generally rectangular in cross section in a plane generally perpendicular to the aperture axis.

26. The electrical connector of claim 22 wherein said electrical contacts are cold formed from sheet metal stock.

27. In combination with the electrical connector of claim 22, a second electrical connector having a body member with a plurality of spaced-apart, contact-receiving apertures extending therethrough along at least one row, and a plurality of electrical contacts disposed in respective ones of said apertures, each contact including a generally rectangular terminal portion protruding from said body member for termination within said slot defined by the prongs of a respective one of said first electrical contacts.

28. The combination of claim 27 wherein each of the electrical contacts for said second electrical connector is cold formed from sheet metal stock.

29. The electrical connector of claim 22 wherein said wide cavity region is spaced from said prongs to permit limited outward flexing thereof sufficient to accommodate said cylindrical male contact member.

* * * * *